United States Patent [19]

Balaban

[11] 4,348,024

[45] Sep. 7, 1982

[54] RACKET STRINGING APPARATUS AND METHOD

[76] Inventor: John A. Balaban, 4142 Graham St., Pleasanton, Calif. 94566

[21] Appl. No.: 115,258

[22] Filed: Jan. 25, 1980

Related U.S. Application Data

[63] Continuation-in-part of Ser. No. 11,145, Feb. 12, 1979, Pat. No. 4,249,732, and Ser. No. 99,215, Dec. 3, 1979, Pat. No. 4,326,713.

[51] Int. Cl.[3] ..... A63B 51/14

[52] U.S. Cl. ..... 273/73 A

[58] Field of Search ..... 273/73 A, 73 B; 73/145; 242/147 R, 149; 269/157, 233, 236; 144/286 R; 51/166 R, 166 TS, 166 FB, 241; 254/249–263

[56] References Cited

U.S. PATENT DOCUMENTS

| | | | |
|---|---|---|---|
| 1,576,390 | 3/1926 | Williams | 273/73 B X |
| 1,863,059 | 6/1932 | Jaffe | 273/73 A |
| 2,067,563 | 1/1937 | Darby | 273/73 A |
| 2,069,736 | 2/1937 | Roberts | 273/73 A |
| 2,146,853 | 2/1939 | Ryckman | 273/73 A |
| 2,154,870 | 4/1939 | Serrano | 273/73 A |
| 2,309,849 | 2/1943 | Kausal et al. | 273/73 A |
| 3,441,275 | 4/1969 | Held | 273/73 A |
| 3,511,502 | 5/1970 | Spenle | 273/73 A |
| 3,913,912 | 10/1975 | Smith | 273/73 A |
| 4,156,525 | 5/1979 | Parnell | 273/73 A |

FOREIGN PATENT DOCUMENTS

| | | | |
|---|---|---|---|
| 1345536 | 10/1963 | France | 273/73 A |
| 1553389 | 12/1968 | France | 273/73 A |
| 402593 | 12/1933 | United Kingdom | 273/73 A |
| 429526 | 5/1935 | United Kingdom | 273/73 A |
| 446447 | 4/1936 | United Kingdom | 273/73 A |
| 528985 | 11/1940 | United Kingdom | 273/73 A |
| 2014458 | 8/1979 | United Kingdom | 273/73 A |

*Primary Examiner*—Richard J. Apley

*Attorney, Agent, or Firm*—Manfred M. Warren; Robert B. Chickering; Glen R. Grunewald

[57] ABSTRACT

A racket stringing apparatus having an open racket head frame holding fixture and means for tensioning a string drawn across the open area of the head frame wherein the fixture is formed as an annulus circumscribing the racket head frame and the latter is rigidly supported interiorly at its yoke and distal ends and exteriorly at its intermediate opposite sides. The conventional string holding clamp is rigidly supported by and in closely coupled relation to the racket head supporting member for minimizing deflection. The head holding fixture is combined with a rotating structure including a conveniently positioned tool supporting tray. A string guide roller ensures aligned passage of the string being tensioned through the racket head openings and proper automatic rotative orientation of the fixture during tensioning of the string. The apparatus further includes an improved string tensioning clamp.

16 Claims, 8 Drawing Figures

RACKET STRINGING APPARATUS AND METHOD

This application is a continuation in part of applications Ser. Nos. 011,145 and 099,215 filed Feb. 12, 1979 and Dec. 3, 1979, respectively and now U.S. Pat. Nos. 4,249,732 and 4,326,713, respectively.

BACKGROUND OF THE INVENTION

1. Field of Invention

The invention relates to machines used for stringing tennis rackets and the like and particularly to those machines which incorporate structure designed to assist in the obtaining of the desired objective of a uniform tensioning of the strings.

2. Description of Prior Art

For prior art disclosures of similar types of racket stringing apparatus see U.S. Pat. Nos. 2,069,736; 2,067,563; 2,154,870; and 3,441,275. These show apparatus of a nature only generally similar to that herein shown, lacking specific features of advantages referred to in the Abstract and hereinafter further described and claimed. More particularly, the supports for holding the racket during the stringing operation are structured in a manner permitting minor but critical flexing thus affecting the resulting string tension, and uniformity of tensioning, and failed to hold the racket head frame against small but critical deflection which likewise affects the tensioning of individual strings and the string-to-string tension across the playing face of the racket. Variations of tension from string to string in rackets strung on prior art machines may vary as much as 10 to 15 pounds. In such case, the primary driving force is imparted to the ball by the tight strings with the looser strings more or less riding free. The presence of adjacent relatively tight and loose strings causes a shift in the direction of exiting of the ball from the racket; and it will be apparent that only a very small angle of error of the ball leaving the racket will produce an error of several feet as the ball reaches the opponent's back court. In tennis and similar games, optimum accuracy in ball placement is critical. Where the racket head is permitted to move or bow during stringing, strings which are placed will be subsequently relaxed if later placed strings shorten the distance across the racket head either longitudinally or transversely. Normally, the main or longitudinal strings are first placed in the racket head. If the racket head is allowed to distort during the placement of the longitudinal strings, the addition of each string reduces the tension of every string that is already in place, thus creating a variation of tension from string to string. When the cross strings are placed in the racket head, an increase in tension of the main strings will normally occur, but the difference in tension from string to string is not corrected.

Other stringing errors may be introduced by the string clamps used to anchor the string as it is tensioned within the racket head and to engage and apply the tensioning force to the string. Prior art structures have permitted minor but critical displacement of the former, and have frequently produced a crushing and damaging of the string in the case of the latter, both of which affect the tensioning and overall quality of the racket.

SUMMARY OF THE INVENTION

The racket head holding structure of the present invention comprises a very rigid annulus circumscribing the racket head frame and carries in close coupled relation thereto both the head supporting members and the required string clamp. Also, importantly, the supporting members are arranged to engage and support the interior surface of the racket head frame at its yoke and distal ends, thus rigidly supporting the longitudinal dimension of the head during installation of the longitudinal strings. At the same time the supporting members are disposed to engage and support the exterior surfaces of the head frame at its opposite sides between its yoke and distal ends thus rigidly retaining the transverse dimension of the head against expansion during installation of the longitudinal strings. As a result, uniformity of tension from string to string may be obtained thus bringing more strings into play causing the racket to play with greater power, efficiency, and accuracy.

Another important advantage in obtaining greater uniformity in tensioning of the strings is to upgrade the playing quality of nylon strings, substantially narrowing the normal gap which has existed between the playing qualities of gut and nylon strings. Nylon string is less resilient than gut and does not stretch as well so that the impairment in playing quality of the racket strung with nylon string is accentuated, as compared to gut, with racket head distortion. While a gut string is thought to play better than a nylon string, stringing of a racket with the greater uniformity in tension obtained by the apparatus of the present invention will bring the nylon play closer to that of gut. In all instances, greater uniformity in tensioning of the strings, nylon or gut, results in greater power, improved accuracy, and a considerably larger "sweet spot" or playing area of the racket. For similar reasons, it is possible with the apparatus of the present invention to obtain a heretofore unobtainable uniformity of tension for both heavy and light gauge strings.

Another cause for string tensioning error is in the frictional binding of the string as it is pulled through the openings in the racket head frame. One of the features of the present invention is the provision of novel string guide means for aligning the tensioning force with the longitudinal axis of the openings in the racket head frame thus obtaining a friction-free drawing of the string through the openings without binding and attendant problems in obtaining uniform tensioning of the strings. At the same time, the string guide means will automatically rotate the head holding fixture to proper position without requiring the operator to set a hand brake to hold the fixture in proper position for each pass of the string through the racket head.

Also included in the racket head holding fixture is a conveniently accessible tool tray which is integrated in the structural support for the fixture.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 1:
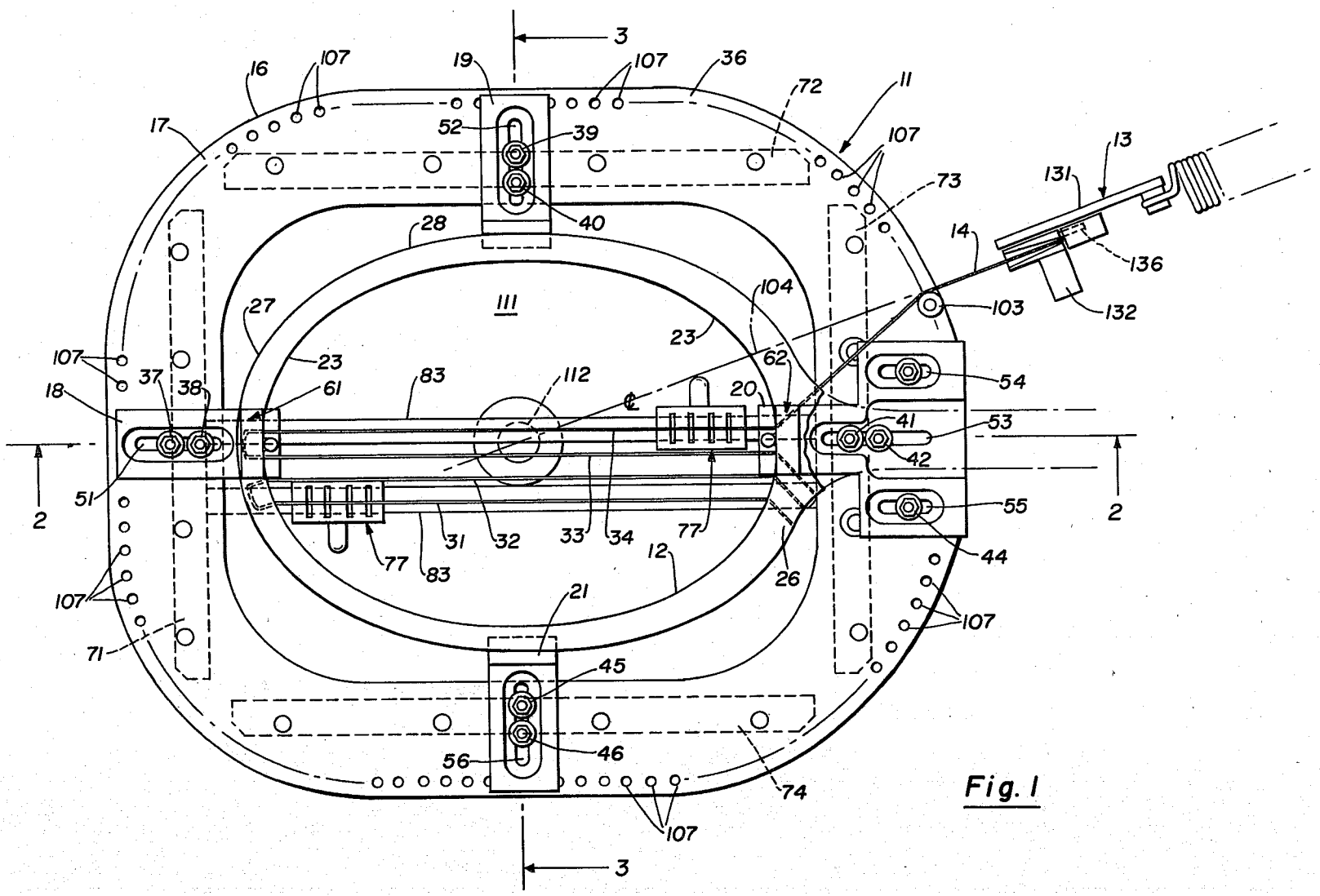
FIG. 1 is a plan view of the portion of a racket stringing apparatus constructed in accordance with the present invention.

The apparatus illustrated in the accompanying drawing comprises a racket head frame holding fixture 11 for an open racket head frame and means 13 for tensioning a string 14 drawn across the open area of head frame 12. The tensioning means may be any of the types known in the art. Reference is here made to the improved string tensioning structure disclosed and claimed in my copending application for RACKET STRINGING APPARATUS AND METHOD filed Dec. 3, 1979, Ser. No. 099,215. The racket head holding fixture here comprises, briefly, an open center frame member 16 having an annulus 17 dimensioned for circumscribing the racket head frame 12; a plurality of head supporting members 18, 19, 20 and 21 mounted on member 16 for movement across annulus 17 for engagement with and for radial support of head frame 12; supporting members 18 and 20 being mounted for engagement with the interior surface 23 of the head frame at its yoke and distal or upper ends 26 and 27; and supporting members 19 and 21 engaging the exterior surface 28 of the head frame at its opposite sides between the yoke and distal ends. In order to generate sufficient strength and to provide for other features of the present invention, frame member 16 is preferably formed as a flat annular plate having a wide planar annulus 17 completely surrounding the racket head to be strung and providing optimum resistance to radial distortion. The head supporting members 18–21 are mounted on the top flat surface of the annulus for movement transversely thereof to and from the racket frame in closely coupled relation to the plane of the frame. Accordingly, supporting members 18–21 have a minimum offset from the plane of frame 16 thereby avoiding any error in tensioning as might be otherwise introduced by deflection of the supporting members under stress. The specific four point support of the racket head frame, i.e. interiorly at its yoke or bow end and at its distal or upper end and exteriorly at midway points on the opposite sides. It is customary to initiate the stringing of the racket head by first placing and tensioning the main or longitudinal strings, starting from adjacent the center of the racket, as shown by longitudinal strings 31, 32, 33 and 34. As the main strings are threaded through the customary openings in the racket head frame and tensioned, the racket head frame will be squeezed in from top to bottom and forced out from side to side. The present supporting structure retains the precise designed shape of the racket frame since the noted frame distortion is prevented by the placement of supports 18–21. As the cross strings are placed and tensioned, the pressure of the racket head frame against supports 18–21 will lessen to zero so that the racket head frame will have its designed shape after all of the strings are placed and tensioned and the racket head removed from the fixture.

Preferably, and as here shown, head supporting members 18–21 are attached to frame member 16 in a manner permitting relative swivel adjustable movement of the supporting members for full-face engagement with the racket head frame surfaces. As will be observed, supporting members 18–21 are in the form of slides mounted on the top surface 36 of annulus 17 and retained thereon by bolts 37 and 38 in the case of member 18, bolts 39 and 40 in the case of member 19, bolts 41, 42, 43 and 44 in the case of member 20, and bolts 45 and 46 in the case of member 21. Member 18 is formed with an elongated passageway 51 for receipt of bolts 37 and 38, and in a similar manner, members 19–21 are formed with elongated passageways 52, 53, 54, 55 and 56 for receiving bolts 39–46. In each instance, the passageways 51–56 are elongated transversely to the annulus 17 so as to permit sliding of the respective support members on the annulus to and from the racket head frame. Also in each instance the diameter of bolts 37–46 is somewhat less than the width of passageways 51–56 thus permitting some swivel action of the support permitting its advance into full-face engagement with the racket head frame surface. Racket head hold-down clamps 61 and 62 are preferably mounted on members 18 and 20 to secure the racket head against vertical displacement in the head holding fixture. As here shown, these clamps comprise threaded bolts 63 and 64, see FIG. 2, mounted through vertical openings in members 18 and 20 and having offset heads 65 and 66 formed to overly the adjacent tennis racket frame and being fitted at the underside of the supporting members with nuts 67 and 68 for tightening down the offset heads 65 and 66 against the upper side of the racket head frame.

Figure 2:
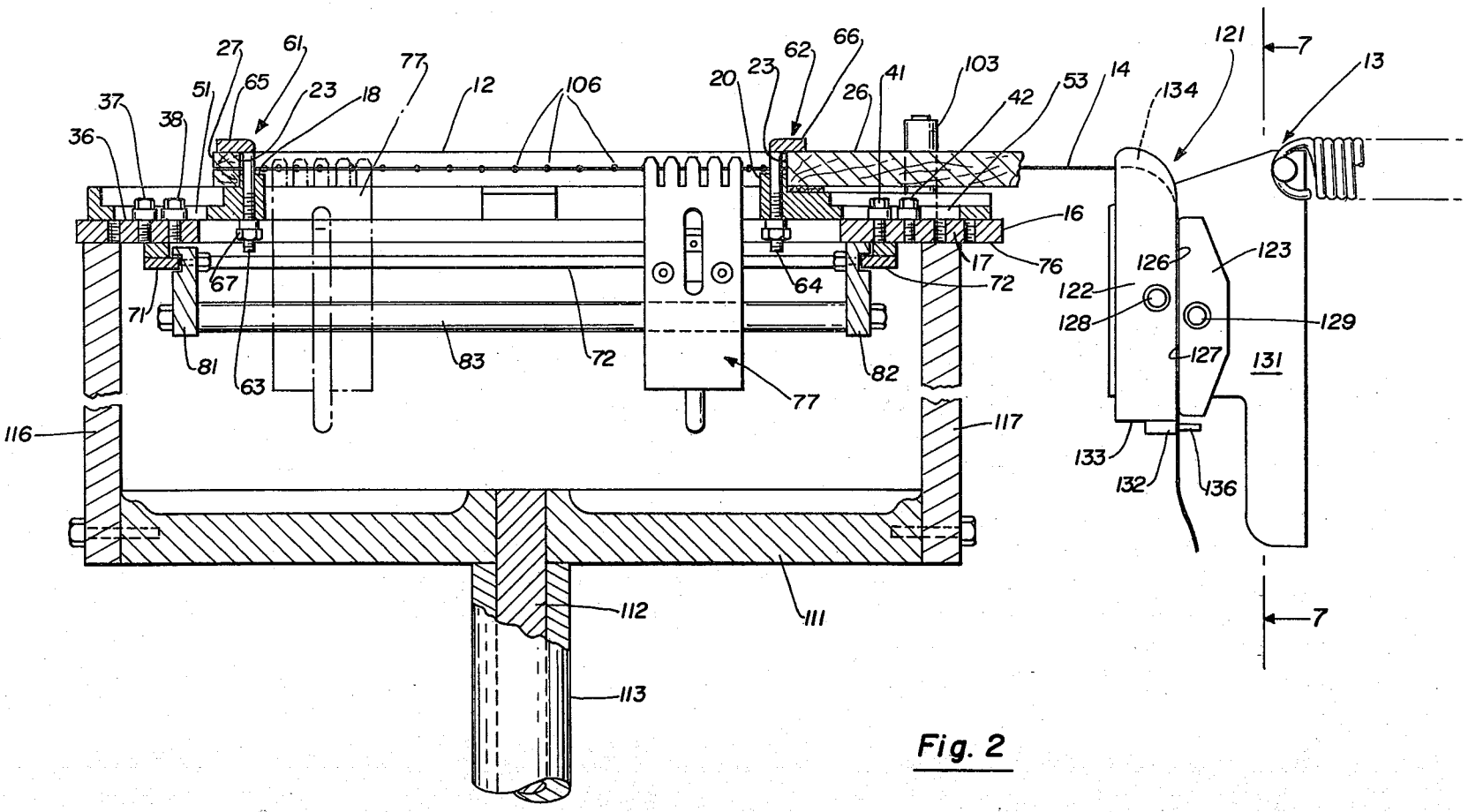
FIG. 2 is a cross-sectional view taken substantially on the plane of line 2—2 of FIG. 1.

In the process of stringing a racket, it is of little value to tension each string with great accuracy and consistency if the design of the string holding clamps and the string holding clamp supports is incapable of retaining that accuracy and consistency during the stringing process. The string holding clamps and their supporting system in the present machine is designed to minimize losses and variables in the string tension. This is here effected by the provision of means, specifically rails 71, 72, 73 and 74 which are fastened directly to the underside 76 of annulus 17, for supporting one or more string clamps 77 for movement to a succession of parallel positions across the open area of the racket head frame parallel to the longitudinal and transverse axes thereof. As will be observed from FIG. 1, rails 71–74 function as guides positioned in pairs with rails 72 and 74 positioned parallel to the longitudinal axis of the racket head frame adjacent the opposite sides thereof and a second pair of rails 71 and 73 being positioned parallel to the transverse axis of the racket head adjacent the yoke and distal ends thereof. Carriage members 81 and 82, see FIG. 2, are formed for longitudinal reciprocation on the guide rails and a rod 83 is mounted with its opposite ends secured to a pair of carriage members. Two assemblies are typically used, one spanning and mounted on rails 71 and 73 and the other being dimensioned for mounting on rails 72 and 74. The rails are positioned with open space between their adjacent ends so that the proper rod and carriage assembly may be readily slipped onto or removed from each pair of guides.

Figure 5:
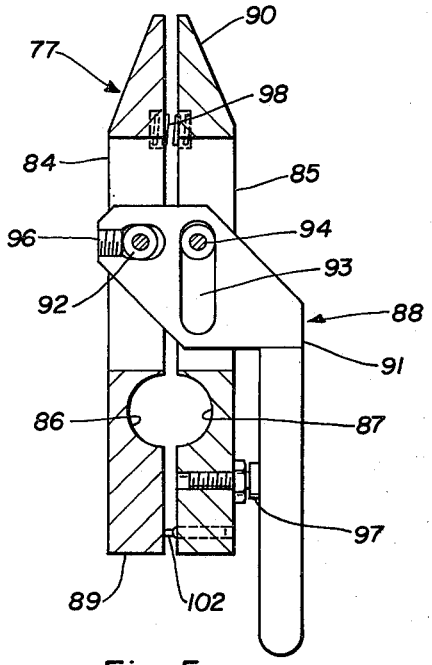
FIG. 5 is a cross-sectional view taken substantially on the plane of line 5—5 of FIG. 4.
Figure 6:
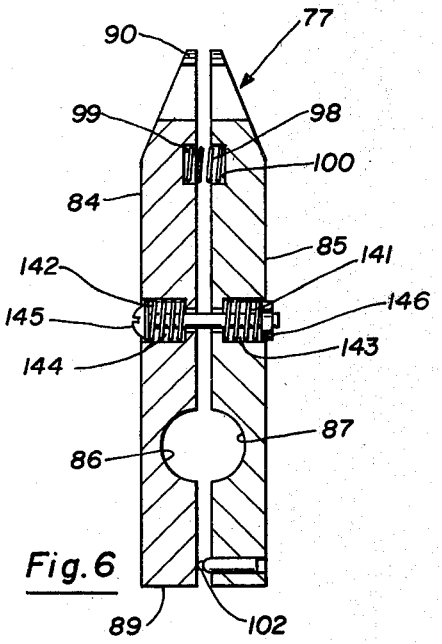
FIG. 6 is a cross-sectional view taken substantially on the plane of line 6—6 of FIG. 4.
Figure 4:
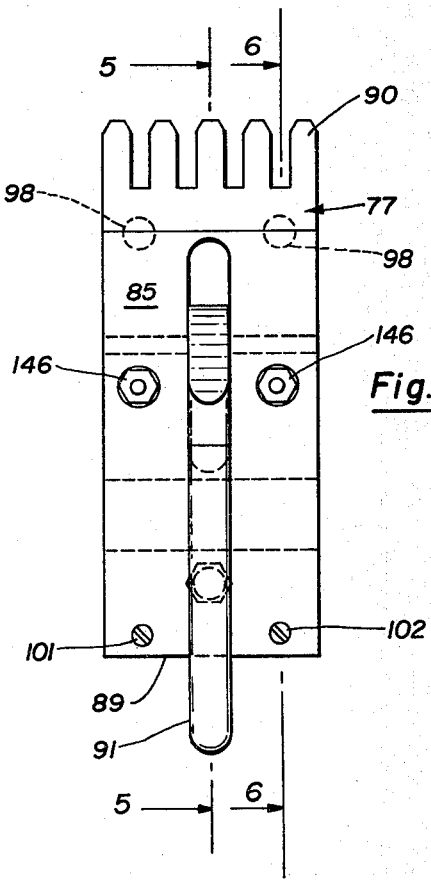
FIG. 4 is an enlarged front elevation of one part of the machine.

String clamp 77 is best seen in FIGS. 4, 5 and 6 and comprises, briefly, a pair of opposed sections 84 and 85 adapted to receive and clamp therebetween a string to be tensioned and having opposed recesses 86 and 87 dimensioned for fitting about opposed portions of rod 83 for longitudinal reciprocation thereon and for movement of the sections together into locked position on the rod; and manually operable means 88 for displacing the sections from and to each other to respectively permit movement of the sections along the rod to desired position and to receive a string therebetween, and to simultaneously lock the sections in position on the rod and to clamp the spring. As here shown, recesses 86 and 87 are positioned adjacent one end 89 of the sections and the latter are formed at their opposite end 90 to receive a string, and means 88 has its operating connections to sections 84 and 85 intermediate ends 89 and 90. Means 88 here comprises a lever 91 having a loss motion pivotal connection 92 to section 84, and the other section 85 and lever having an interfitting cam slot 93 and follower 94 mounted therein whereby arcuate displacement of the lever about pivotal connection 92 will effect displacement of sections 84 and 85 to and away from each other. Set screw 96 and stop 97 engaging lever 91 determine the maximum closing movement of the sections. Preferably, a pair of springs 98 mounted in opposed recesses 99 and 100 adjacent the normally upper end 90 of the clamp, and springs 141 and 142 mounted in recesses 143 and 144, see FIG. 6, medially of the sections and retained by adjustable bolt and nut members 145 and 146 in sections 84 and 85 function to bias the sections to open position. As will be observed from FIG. 4, the biasing springs 98 and 141, 142 are positioned on opposite sides of centrally positioned lever 191. As here shown, springs 98, 141 and 142 are mounted above rod retaining recesses 86 and 87 and function to normally produce a fulcruming contact of the lower end 89 of the sections in the movement of the sections to and away from each other, the springs and means 88 permitting forced manual separation of the sections at end 89 for mounting onto and removal from rod 83. Preferably, a pair of spring-loaded plungers 101 and 102 on opposite sides of lever 191, see FIGS. 4 and 6 are mounted at the base end 89 of the sections to ensure opening of the sections sufficient to obtain smooth, easy sliding of the clamp along the rod. A close coupling of the clamp support to the underside of the top plate 16 permits the use of a short and very rigid string clamp which grips very tightly on the glide rods 83 without damaging the strings. The body of the clamp is also designed to allow the metal to bend or flex in the plane perpendicular to rod 83 as the clamping force is applied to reduce the need for adjusting the clamp for changes in string diameter.

Figure 8:
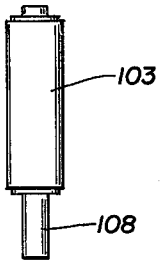
FIG. 8 is a side elevation on an enlarged scale of the string guide forming part of the apparatus.

As another feature of importance in the present structure, friction between the string and racket head is reduced by the use of a string guide 103 which is mounted on frame member 16 in position to align the pull of the string with the length of the opening in the racket head through which the string is drawn. Another function of the guide is to automatically dispose the line of pull between the guide and tensioning means 13 to intercept a central axis of rotation about which the fixture may revolve, see phantom line 104 in FIG. 1. In the present structure, guide 103 may be positioned on annulus 17 externally of the racket head frame so as to provide the proper alignment of pull when tensioning the string through substantially all of the openings 106 in the racket head frame and in each instance to automatically align the line of pull between the guide and the tensioning means to intercept the central rotating axis of the fixture. As here shown, see FIGS. 1, 2 and 8, guide 103 comprises a roller member positionable on the annulus adjacent to and having its periphery aligned with each of the openings. This is accomplished by providing the annulus with a plurality of peripherally spaced openings 107 and providing roller member 103 with a shank 108 formed for detachably mounting in each of openings 107. The alignment of forces provided by string roller guide 103 eliminates the need for the conventionally used brake to prevent the fixture from turning while the string is being tensioned.

Another feature of the present apparatus is the incorporation in the rotating head structure of a tool tray 111 disposed directly below the working area for very easy access to stringing tools. Since all of the string-engaging structure is carried by the top plate, there is no need, as in earlier racket stringing machines, to extend string clamps and other supports up from a base structure. Thus, the area under top plate 16 is open and accessible. As here shown, a tool tray 111 is secured to member 16 in dependent, substantially parallel relation thereto; a shaft 112 is secured and depends from the tray to form the rotating axis for the top fixture; and a bearing 113 is provided as part of the base support for the machine and functions to journal shaft 112 for rotation. Tool tray 111 may be secured to top plate 16 by a pair of vertically set arms 116 and 117 bolted top and bottom to plate 16 and tool tray 111.

Figure 7:
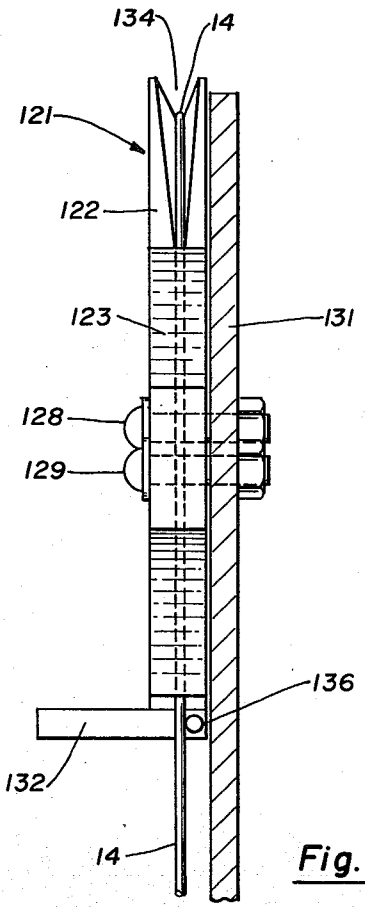
FIG. 7 is a cross-sectional view on an enlarged scale taken substantially on the plane of line 7—7 of FIG. 2.
Figure 3:
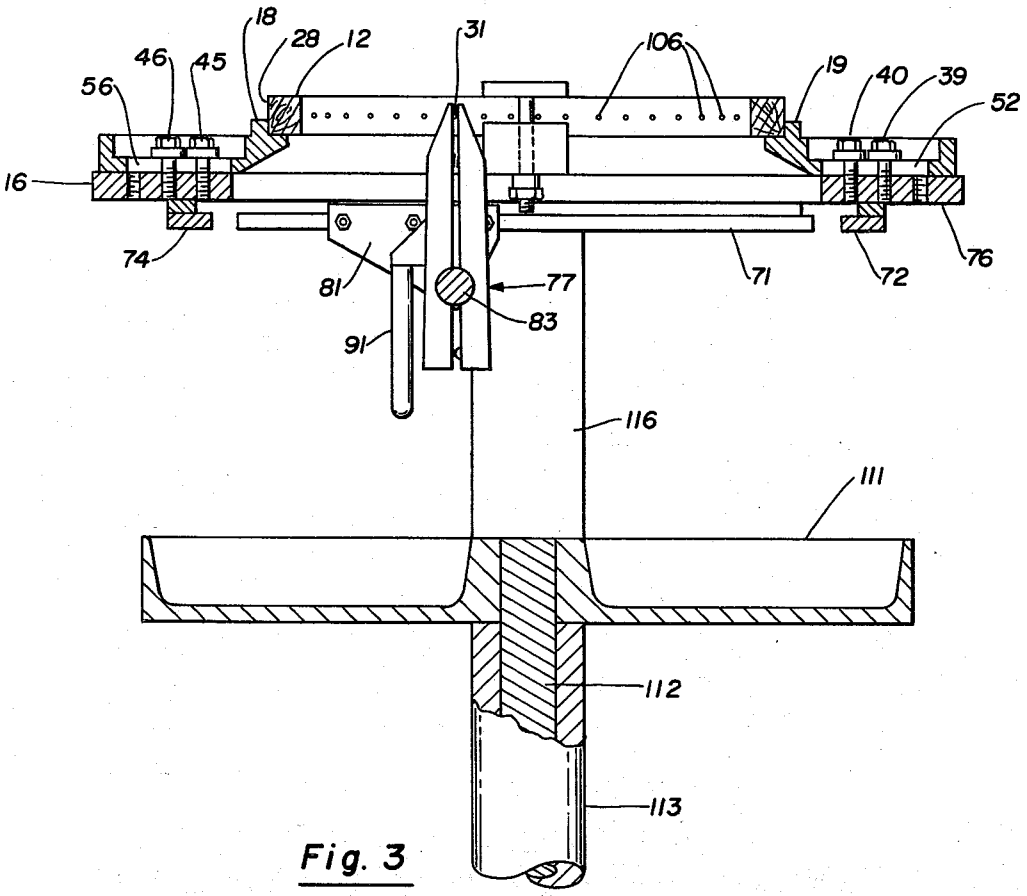
FIG. 3 is a cross-sectional view taken substantially on the plane of line 3—3 of FIG. 1.

The string tensioning means is more fully disclosed in my copending application aforesaid and includes a string clamp 121 best seen in FIGS. 2 and 7. This clamp comprises, briefly, a pair of pivotally supported elongated members 122 and 123, pivoted intermediate their ends about parallel axes and having flat elongated surfaces 126 and 127 in closely spaced substantially parallel planes parallel to the pivotal axes. The members are here mounted by pivot pins 128 and 129 to a normally vertically set supporting plate 131 to lie substantially coplanar with the line of tensioning with string 14 with the string mounted on an upper end of member 122 and extended between surfaces 126 and 127 whereby the tensioning of the string will effect rotary displacement of member 122 about its pivot 128 so as to cause a movement of the opposed surfaces into clamping relation on the string. The latter result is obtained by mounting pivot pins 128 and 129 in longitudinally offset relation. As will be observed from FIG. 2, pivot pin 128 is at an elevation higher than pivot pin 129 so that rotation of member 122 in a clockwise direction, as viewed in FIG. 2, will cause an opening up of the space between surfaces 126 and 127, and contrariwise, counterclockwise rotation of member 122 will cause a closing of this space.

Preferably, one of the members, here member 122, is provided with a handle 132 which projects forwardly from the bottom end 133 of the member for manual engagement and displacement of the members to open position of the surface for receipt or removal of the string. Also, member 122 is recessed at its upper end to form a V-shaped string centering groove 134 and means is provided at the lower end of the clamp for locating the string between the clamping surfaces 126 and 127 centrally thereof. The latter means here comprises a string engaging stop 136 adjacent the lower end of member 122 and against which the string may be readily positioned when the surfaces are opened. After insertion of the string, release of handle 132 will permit the sections to automatically rotate to string clamping position and the ensuing tensioning of string 14 and torque applied to member 122 will cause the surfaces 126 and 127 to firmly clamp the string therebetween. Due to the long length of string contained between the surfaces, high clamping force can be readily obtained without danger of crushing or otherwise damaging the string. In stringing a racket a considerable length of string is used. In the case of the present clamp, the long length of string depends from the bottom of the clamp well out of possible entanglement with other portions of the machine.

What is claimed is:

1. In a racket stringing apparatus having an open racket head frame holding fixture and means for tensioning a string drawn across the open area of said head frame, said fixture comprising;

an open center frame member having an annulus dimensioned for circumscribing the racket head frame;

a plurality of head supporting members mounted on said member for movement across said annulus for engagement with and for radial support of said head frame;

means mounted on said frame member for supporting a string clamp for movement to a succession of parallel positions across the open area of said racket head frame parallel to the longitudinal and transverse axes thereof;

said last-named means comprising a pair of guides positioned parallel to the longitudinal axis of the racket head frame adjacent opposite sides thereof;

a second pair of guides positioned parallel to the transverse axis of the racket head frame and adjacent said yoke and distal ends thereof;

carriage members formed for longitudinal reciprocation on said guides;

a rod having opposite ends secured to said carriage members and being adapted for mounting of said clamp along the length thereof;

said annulus being formed with opposed substantially flat planar surfaces;

said supporting members being mounted on one surface; and said guides comprising rails mounted on the other of said surfaces.

2. The apparatus of claim 1, and a string clamp mounted for longitudinal reciprocation on said rod and comprising:

a pair of opposed sections adapted to receive and clamp therebetween a string to be tensioned and having opposed recesses dimensioned for fitting about opposed portions of said rod for longitudinal reciprocation thereon and for movement together into locked position on said rod; and manually operarble means for displacing said sections from and to each other to respectively permit movement of said sections along said rod to desired position and to receive a string therebetween, and to simultaneously lock said sections in position on said rod and to clamp said string.

3. The apparatus of claim 2, said recesses being positioned adjacent one end of said sections, said sections being formed at their opposite end to receive said string; and said manually operable means having connections to said sections intermediate said ends.

4. The apparatus of claim 3, said means comprising: a lever having a loss motion pivotal connection to one of said sections, the other of said sections and lever having an interfitting cam slot and follower connection whereby arcuate displacement of said lever about said pivotal connection will effect said displacement of said sections to and from each other.

5. The apparatus of claim 3, and spring means mounted to said sections and urging their separation.

6. The apparatus of claim 5, said spring means being mounted adjacent said opposite end of said sections to normally produce fulcruming contact of said one end of said sections in the movement of said sections to and away from each other.

7. The apparatus of claim 6, said manually operable means and spring means permitting manual separation of said sections at said one end for mounting on and removal from said rod.

8. A string clamp for mounting on a string clamp supporting rod of a racket stringing apparatus comprising:

a pair of opposed sections adapted to receive and clamp therebetween a string to be tensioned and having opposed recesses dimensioned for fitting about opposed portions of said rod for longitudinal reciprocation thereon and for movement together to locked position on said rod;

manually operable means for displacing said sections from and to each other to respectively permit movement of said sections along said rod to desired position and to receive a string therebetween, and to simultaneously lock said sections in position on said rod and to clamp said string;

said recesses being positioned adjacent one end of said sections with said sections being formed at their opposite end to receive said string;

said manually operable means comprising a lever having connections to said sections intermediate said ends, one of said connections being a loss motion pivotal connection and the other of said connections comprising an interfitting cam slot and follower whereby arcuate displacement of said lever about said pivotal connection will effect said displacement of said sections to and from each other;

spring means mounted adjacent said opposite ends of said sections and urging their separation and normally producing contact fulcruming of said one end of said sections in the movement of said sections to and away from each other; and said manually operable means and said spring means permitting manual separation of said sections at said one end for mounting on and removal from said rod.

9. A racket stringing apparatus comprising:

a member dimensioned for circumscribing and supporting the open head of a racket frame having a plurality of circumferentially spaced openings therethrough;

means for engaging and tensioning a string drawn through one of said openings and across the open area of said head frame;

means supporting said member for rotation about an axis centrally of said racket head and perpendicular to the plane thereof; and a string guide mounted on said member in position to align the pull of said string with the length of said one opening and to dispose the line of pull between said guide and tensioning means to intercept said axis;

said guide being positioned externally of said racket head frame and being formed to provide said alignment of pull when tensioning said string through substantially all of said openings and in each instance to automatically align the line of pull between said guide and tensioning means to intercept said axis.

10. The apparatus of claim 9, said guide comprising a roller member positionable on said member adjacent to and having its periphery aligned with each of said openings.

11. The apparatus of claim 10, said member having a plurality of peripherally spaced openings; and said roller member having a shank formed for demountable positioning in each of said last-named openings.

12. The apparatus of claim 9, said last-named means comprising:

a tool tray secured to said member in dependent substantially parallel relation thereto;

a shaft secured to and depending from said tray coincident with said axis; and a bearing journaling said shaft for rotation.

13. In a racket stringing apparatus having a racket head frame holding fixture and means movable with respect to said fixture and having a string engaging clamp for securing a string for tensioning in the racket head frame, said clamp comprising:

a pair of elongated members mounted in side-by-side relation and each pivoted to said means intermediate its ends about parallel axes, said members having elongated confronting surfaces mounted in closely spaced substantially parallel planes parallel to said axes;

said members being mounted to said means substantially coplanar with the line of movement thereof for tensioning said string and being positioned for threading of said string over and upon one end of one of said members and between said surfaces whereby the tensioning of said string will effect rotary displacement of one said member about its pivotal axis; and said pivotal axes being longitudinally offset from each other whereby said rotary displacement of said one member will produce an automatic clamping action of said string between said surfaces as a function of the tension imparted to said string.

14. The apparatus of claim 13, said one member having a handle portion for manual engagement and displacement of said members to an open position of said surfaces for receipt or removal of said string.

15. The apparatus of claim 14, said one member being formed at said end for centering said string thereon; and means on one of said members for locating said string between said surfaces centrally thereof.

16. The apparatus of claim 15, said last-named means comprising a string-engaging stop adjacent the opposite end of said one member.

* * * * *